US005254522A

United States Patent [19]

Zink et al.

[11] Patent Number: 5,254,522

[45] Date of Patent: * Oct. 19, 1993

[54] PRESSURE-SENSITIVE OR HEAT-SENSITIVE RECORDING MATERIAL

[75] Inventors: Rudolf Zink, Therwil; Peter Möckli; Peter Rohringer, both of Schönenbuch, all of Switzerland

[73] Assignee: Ciba-Geigy Corporation, Ardsley, N.Y.

[ * ] Notice: The portion of the term of this patent subsequent to May 7, 2008 has been disclaimed.

[21] Appl. No.: 675,213

[22] Filed: Mar. 26, 1991

[30] Foreign Application Priority Data

Mar. 29, 1990 [CH] Switzerland ..... 1035/90

[51] Int. Cl.[5] ..... B41M 5/136; B41M 5/145

[52] U.S. Cl. ..... 503/217; 503/216; 503/225

[58] Field of Search ..... 503/218, 217, 221, 216, 503/225

[56] References Cited

U.S. PATENT DOCUMENTS

| | | | |
|---|---|---|---|
| 3,162,763 | 12/1964 | Huett | 503/220 |
| 3,174,038 | 3/1965 | Briggs | 503/220 |
| 4,011,352 | 3/1977 | Janssons et al. | 427/145 |
| 4,180,656 | 12/1979 | Garner | 542/423 |
| 4,595,768 | 6/1986 | Schmidt et al. | 503/220 |
| 4,688,059 | 8/1987 | Schmidt et al. | 503/220 |
| 4,870,500 | 9/1989 | Hung | 503/224 |
| 5,013,707 | 5/1991 | Phaff et al. | 503/212 |
| 5,024,988 | 6/1991 | Zink et al. | 503/212 |

FOREIGN PATENT DOCUMENTS

| | | |
|---|---|---|
| 2718225 | 11/1977 | Fed. Rep. of Germany . |
| 2243829 | 4/1975 | France . |
| 0603370 | 8/1978 | Switzerland . |

*Primary Examiner*—Pamela R. Schwartz

*Attorney, Agent, or Firm*—Marla J. Mathias; George R. Dohmann

[57] ABSTRACT

A pressure-sensitive or heat-sensitive recording material essentially comprising in its color reactant system (A) an aromatic or nitrogen-containing heterocyclic aldehyde, (B) an organic condensation component containing an activated methylene group or a primary or secondary nitrogen atom, preferably a primary amino group, and (C) an electrophilic and color-developing component.

23 Claims, No Drawings

PRESSURE-SENSITIVE OR HEAT-SENSITIVE RECORDING MATERIAL

The present invention relates to a pressure-sensitive or heat-sensitive recording material essentially comprising in its colour reactant system (A) an aromatic or nitrogen-containing heterocyclic aldehyde, (B) an organic condensation component containing an activated methylene group or a primary or secondary nitrogen atom, preferably a primary amino group, and (C) an electrophilic and colour-developing component.

Depending on the recording material, components (A), (B) and (C) come in contact with one another and leave images on the substrate. The coloured image so produced depends on the nature of components (A) and (B), which constitute the electron donor and form the chromogenic part. Component (C) effects the colour formation. Appropriate combination of the individual components is thus able to produce the desired colours, for example yellow, orange, red, violet, blue, green, grey, black or combination colours. A further possibility consists in using components (A) and (B) together with one or more conventional colour formers such as 3,3-(bisaminophenyl)phthalides such as CVL, 3-indolyl-3-aminophenylaza-or -diazaphthalides, (3,3-bisindolyl)-phthalides, 3-aminofluorans, 6-dialkylamino-2-dibenzylaminofluorans, 6-dialkylamino-3-methyl-2-arylaminofluorans, 3,6-bisalkoxyfluorans, 3,6-bis(-diarylamino)fluorans, leucoauramines, spiropyanes, spirodipyranes, chromenopyrazoles, chromenoindoles, phenoxazines, phenothiazines, quinazolines, rhodamine lactams, carbazolylmethanes or triarylmethanes.

The aromatic aldehydes suitable for use as component (A) preferably have the formula

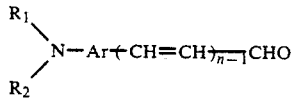

(1)

wherein $R_1$ and $R_2$ are each independently of the other alkyl of not more than 12 carbon atoms which is unsubstituted or substituted by hydroxy, cyano or lower alkoxy, acyl of 1 to 8 carbon atoms, cycloalkyl of 5 to 10 carbon atoms, or phenylalkyl containing 1 to 3 carbon atoms in the alkyl moiety or phenyl, each unsubstituted or ring-substituted by halogen, cyano, lower alkyl, lower alkoxy or lower alkoxycarbonyl, and $R_2$ is also hydrogen, or $R_1$ and $R_2$, together with the linking nitrogen atom, are a 5- or 6-membered, preferably saturated, heterocyclic radical, Ar is naphthylene or phenylene which may each be substituted by hydroxy, halogen, cyano, nitro, trihalomethyl, lower alkyl, methylsulfonyl, lower alkoxy, acyloxy, lower alkylamino, di-lower alkylamino, acylamino containing 1 to 8 carbon atoms, benzyloxy or phenoxy, and n is 1 or 2.

Substituents $R_1$ and $R_2$ defined as alkyl groups may be straight chain or branched. Such alkyl groups are typically methyl, ethyl, n-propyl, isopropyl, n-butyl, isobutyl, sec-butyl, tert-butyl, amyl, isoamyl, n-hexyl, 2-ethylhexyl, n-heptyl, n-octyl, 1,1,3,3-tetramethylbutyl, isooctyl, n-nonyl, isononyl or n-dodecyl.

Substituted alkyl groups $R_1$ and $R_2$ are preferably cyanoalkyl, haloalkyl, hydroxyalkyl, alkoxyalkyl, each preferably containing a total of 2 to 8 carbon atoms, typically 2-cyanoethyl, 2-chloroethyl, 2-hydroxyethyl, 2-methoxyethyl, 2-ethoxyethyl, 2,3-dihydroxypropyl, 2-hydroxy-3-chloropropyl, 3-methoxypropyl, 4-methoxybutyl or 4-propoxybutyl.

$R_1$ and $R_2$ as cycloalkyl are cyclopentyl or, preferably, cyclohexyl.

A heterocyclic radical-$NR_1R_2$ is typically pyrrolidino, piperidino, pipecolino, morpholino, thiomorpholino, piperazino, N-alkylpiperazino, for example N-methylpiperazino, N-phenylpiperazino or N-alkylimidazolino. Preferred saturated heterocyclic radicals -$NR_1R_2$ are pyrrolidino, piperidino or morpholino.

$R_1$ and $R_2$ as phenalkyl preferably contain a total of 7 to 9 carbon atoms and are normally $\alpha$-methylbenzyl, phenethyl, phenisopropyl or, most preferably, benzyl which may preferably also be ring-substituted.

Preferred substituents of the benzyl group and of the phenyl group $R_1$ and $R_2$ are typically halogen, methyl or methoxy. Illustrative examples of such araliphatic and aromatic radicals are p-methylbenzyl, o- or p-chlorobenzyl, 2,5-dimethylbenzyl, o-or p-tolyl, xylyl, 2,6-dimethylphenyl, o-, m- or p-chlorophenyl, o- or p-methoxyphenyl, o- or p-chlorobenzyloxy or o- or p-methylbenzyloxy.

The substituents $R_1$ and $R_2$ are preferably cyclohexyl, benzyl, tolyl, phenethyl, lower alkoxy-lower alkyl, cyano-lower alkyl, such as $\beta$-cyanoethyl or, most preferably, lower alkyl, such as methyl, ethyl or n-butyl. -$NR_1R_2$ is preferably also pyrrolidinyl.

Particularly preferred compounds of formula (1) are those wherein $R_1$ and $R_2$ are each lower alkyl, chloro-lower alkyl, cyano-lower alkyl, benzyl, phenyl, or -$NR_1R_2$ is pyrrolidino, piperidino or morpholino, Ar is naphthylene or phenylene which may each be substituted by hydroxy, halogen, trifluoromethyl, lower alkyl or lower alkoxy, and n is 1 or 2.

Suitable aldehydes are conveniently also aromatic compounds which preferably have the formula

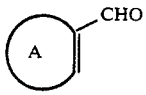

(2)

wherein A is a mononuclear or polynuclear aryl radical which may be substituted by hydroxy, halogen, cyano, nitro, lower alkyl, lower alkoxy or lower alkoxycarbonyl. The aryl radical is derived from, for example, benzene, diphenyl, naphthalene, anthracene, acenaphthene, acenaphthylene or pyrene. The nitrogen-containing heterocyclic aldehydes required as component (A) conveniently have the formula

Z-CHO (3)

wherein Z is an unsubstituted or substituted pyrrolyl, antipyrinyl, triazinyl, indolyl, carbazolyl, julolidinyl, kairolinyl, indolinyl, iminodibenzyl, dihydroquinolinyl or tetrahydroquinolinyl radical.

The mononuclear or polynuclear heterocyclic radical Z may carry one or more ring substituents. Suitable C-substituents are typically halogen, hydroxy, cyano, nitro, lower alkyl, lower alkoxy, lower alkylthio, lower alkoxycarbonyl, acyl of 1 to 8 carbon atoms, preferably lower alkylcarbonyl, lower alkylamino, lower alkylcarbonylamino or di-lower alkyl-amino, $C_5$–$C_6$cycloalkyl, benzyl or phenyl; and N-substituents are typically $C_1$–$C_{12}$alkyl, $C_2$–$C_{12}$alkenyl, $C_5$–$C_{10}$cycloalkyl, $C_1$–$C_8$acyl, phenyl, benzyl, phenethyl or phenisopropyl, which may each be substituted by cyano, halogen, nitro, hydroxy, lower alkyl, lower alkoxy, lower alkylamino or lower alkoxycarbonyl.

The alkyl and alkenyl radicals may be straight chain or branched. Such radicals are typically methyl, ethyl, n-propyl, isopropyl, n-butyl, 1-methylbutyl, tert-butyl, sec-butyl, amyl, isopentyl, n-hexyl, 2-ethylhexyl, isooctyl, n-octyl, 1,1,3,3-tetramethylbutyl, nonyl, isononyl, 3-ethylheptyl, decyl or n-dodecyl, and, respectively, vinyl, allyl, 2-methylallyl, 2-ethylallyl, 2-butenyl or octenyl.

Preferred heterocyclic radicals Z are unsubstituted or substituted 2-or 3-pyrrolyl radicals, 3-indolyl radicals or indolinyl radicals, such as 2-pyrrolyl, N-$C_1$–$C_8$alkylpyrrol-2-yl, N-phenylpyrrol-3-yl, 3-indolyl, N-$C_1$–$C_8$alkyl-2-methylindol-3-yl, N-$C_2$–$C_4$alkanoyl-2-methylindol-3-yl, 2-phenylindol-3-yl, N-$C_1$–$C_8$alkyl-2-phenylindol-3-yl, N-$C_1$–$C_8$alkyl-carbazol-3-yl or 1,3,3-trimethyl-2-methenylindolinyl radicals.

"Acyl" is preferably formyl, lower alkylcarbonyl, typically acetyl or propionyl, or benzoyl. Further suitable acyl radicals are lower alkylsulfonyl, typically methylsulfonyl or ethylsulfonyl as well as phenylsulfonyl. Benzoyl and phenylsulfonyl may be substituted by halogen, methyl, methoxy or ethoxy.

Lower alkyl, lower alkoxy and lower alkylthio denote those groups or moieties which contain 1 to 6, preferably 1 to 3, carbon atoms. Illustrative of such groups are methyl, ethyl, n-propyl, isopropyl, n-butyl, sec-butyl, amyl, isoamyl or hexyl; methoxy, ethoxy, isopropoxy, isobutoxy, tert-butoxy or amyloxy; and methylthio, ethylthio, propylthio or butylthio.

Halogen is fluoro, bromo or, preferably, chloro.

Specific examples of aldehydes of formulae (1), (2) and (3) suitable for use as component (A) include:

4-dimethylaminobenzaldehyde, 4-N-methyl-N-β-cyanoethylaminobenzaldehyde, 4-diethylaminobenzaldehyd, 4-(di-(β-cyanoethylamino)benzaldehyde, 4-di-n-propylaminobenzaldehyde, 4-dibenzylaminobenzaldehyde, 4-(di-β-hydroxyethylamino)-benzaldehyde, 4-N-ethyl-N-benzylaminobenzaldehyde, 4-dimethylamino-2-methylsulfonylbenzaldehyde, 4-pyrrolidinobenzaldehyde, 4-morpholinobenzaldehyde, 4-(N-β-chloroethyl-N-ethylamino)-benzaldehyde, 4-diallylaminobenzaldehyde, 4-(N-phenyl-N-methylamino)benzaldehyde, 4-(N-β-hydroxyethyl-N-ethylamino)-2-methylbenzaldehyde, 4-dimethylaminosalicylaldehyde, 4-di-n-propylaminosalicylaldehyde, 4-dimethylamino-2-cyanobenzaldehyde, 4-dimethylamino-2-carbomethoxybenzaldehyde, 4-dimethylamino-2-methoxybenzaldehyde, 4-diethylamino-2-methoxybenzaldehyde, 4-diethylamino-2-hydroxybenzaldehyde, 4-dimethylamino-3-chlorobenzaldehyde, 4-dimethylamino-2,6-dimethylbenzaldehyde, 4-diethylamino-2-methylbenzaldehyde, 4-dimethylamino-2-nitrobenzaldehyde, 4-dimethylaminocinnamaldehyde, 4-diethylaminocinnamaldehyde, indole-3-aldehyde, N-ethylcarbazole-3-aldehyde, 2-methylindole-3-aldehyde, 4-phenylaminobenzaldehyde, 2-diethylaminothiazole-5-aldehyde, pyrrole-2-aldehyde, N-methyl-pyrrole-2-aldehyde, 1-methylindole-3-aldehyde, 1-methyl-2-phenylindole-3-aldehyde, 1-ethyl-2-methylindole-3-aldehyde, 1-n-octyl-2-methylindole-3-aldehyde, 1-β-cyanoethyl-2-phenylindole-3-aldehyde, julolidinaldehyde, 3,3-dimethyl-2-methylenindoline-ω-aldehyde, 1,3,3-trimethyl-2-methylenindoline-ω-aldehyde, 1,3,3-trimethyl-5-cyano-2-methylenindoline-ω-aldehyde, 1,3,3-trimethyl-5-acetylamino-2-methylenindoline-ω-aldehyde, 1,3,3-trimethyl-5-carbomethoxy-2-methylenindoline-ω-aldehyde, 1,3,3-trimethyl-5-chloro-2-methylenindoline-ω-aldehyde, antipyrinaldehyde, iminodibenzylaldehyde, salicylaldehyde, 3-methoxy-4-hydroxybenzaldehyde, 4-methoxybenzaldehyde, 2,4-dimethoxybenzaldehyde, 3,4,5-trimethoxybenzaldehyde, 2,4,6-trimethoxybenzaldehyde, 2-hydroxy-1-naphthaldehyde, acenaphthenaldehyde, anthraldehyde, pyrenaldehyde, 6-chloro-2-hydroxy-1-naphthaldehyde, 4-methoxysalicylaldehyde, 8-methoxycarbonyl-2-hydroxy-1-naphthaldehyde.

Preferred specific components (A) are 4-dimethylaminobenzaldehyde, 4-diethylaminobenzaldehyde, 4-dimethylaminocinnamaldehyde and indole-3-aldehyde.

The eligible components (B), which form chromogenic compounds with component (A), are preferably monocyclic or polycyclic aromatic heterocyclic compounds which complete a system of conjugated double bonds and, if necessary, contain in addition to the condensable methylene group or primary or secondary amino group auxochromic substituents, such as disubstituted amino groups, typically di-lower alkylamino groups, hydroxyl groups, ether groups such as alkoxy groups, thiol groups or mercapto groups, such as alkylthio.

Such compounds are preferably derived from aromatic amines or from nitrogen-containing heterocycles, typically from the series of the anilines, naphthylamines, aminoanilines, anilinesulfoanilides, aminophenylethylene compounds, aminophenylstyrene compounds, acylacetarylamides, 3-aminophenol ethers, aminopyrazoles, aminothiazoles, pyrazolones, barbituric acids, pyrrolidines, piperidines, piperazines, morpholines, benzomorpholines, indolines, cyanomethylbenzimidazoles, cyanomethylbenzoxazoles or cyanomethylbenzothiazoles.

Preferred condensation components (B) are anilines, such as cresidines or phenetidines as well as aminodiphenylamines and toluidinesulfoanilides.

Most preferred are anilines of formula

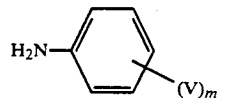

(4)

wherein

V is hydrogen, hydroxy, halogen, trifluoromethyl, lower alkyl, lower alkoxy, lower alkoxycarbonyl, lower alkanoyloxy, benzyloxy or phenoxy, and m is 1 or 2, One V is preferably in ortho-position to the amino group.

Specific examples of condensation components (B) are aniline, 2-amino-4-methoxytoluene, 2-amino-4-hydroxy-toluene, 3-amino-4-methoxytoluene, 4-methoxyaniline, malodinitrile, 4-ethoxyaniline, 2,5-dimethoxyaniline, 4-methylaniline, 4-ethylaniline, 4-n-butylaniline, 2-methylaniline, 3-methylaniline, 4-isopropylaniline, 2-phenoxy-3-chloroaniline, 4-(4'-chlorophenoxy)aniline, 4-acetylaminoaniline, 4-benzoylaminoaniline, 3-acetylamino-4-methylaniline, 4-aminotoluene-2-sulfoanilide, 4-aminotoluene-2-sulfo-N-ethylanilide, 1-phenyl-3-methyl-5-pyrazolone, 1-phenyl-5-methyl-3-pyrazolone, 4-aminodiphenylamine, 1-(2'-chlorophenyl)-5-methyl-3-pyrazolone, naphthylamine, 1-amino-7-naphthol, 3-methyl-5-aminopyrazole, 1-(4'-tolyl)-3-methyl-5-aminopyrazole, 2-(4'-aminophenyl)-6-methylbenzothiazole, 2-cyanomethylbenzothiazole, 3-phenyl-4-methylindolizine, 2,3-diphenylindolizine.

Preferred components (B) are also phthalides and, more particularly, fluorans, which contain at least one primary amino. These phthalides and fluorans are disclosed, for example, in FR-A-1 553 291, GB-A-1 211 393, DE-A-2 138 179, DE-A-2 422 899 and EP-A-138 177.

Specific examples of such components (B) are:
2-amino-6-diethylaminofluoran,
2-amino-6-dimethylaminofluoran,
2-amino-6-di-n-butylaminofluoran,
2-amino-3-chloro-6-diethylaminofluoran,
3-chloro-6-aminofluoran,
2-amino-3-methyl-6-diethylaminofluoran,
3,3-bis(4'-dimethylaminophenyl)-6-aminophthalide,
3,3-bis(4'-aminophenyl)-6-dimethylaminophthalide,
3,3-bis(4'-diethylaminophenyl)-6-amino-phthalide.

The amounts in which components (A) and (B) are used are not critical; however, it is preferred to use equimolar amounts.

Both components (A) as well as the condensation component (B) may be used in the recording material by themselves alone or in the form of a combination of two or more of the same.

The developers employed may suitably be the inorganic or organic colour developers customarily used in recording materials and which are capable of attracting electrons (electron acceptors).

Typical examples of inorganic developers are activated clay substances such as attapulgus clay, acid clay, bentonite, montmorillonite; activated clay such as acid-activated bentonite or montmorillonite as well as halloysite, kaolin, zeolith, silica, zirconium dioxide, alumina, aluminium sulfate, aluminium phosphate or zink nitrate.

Preferred inorganic colour developers are Lewis acids such as aluminum chloride, aluminium bromide, zink chloride, iron(III) chloride, tin tetrachloride, tin dichloride, tin tetrabromide, titanium tetrachloride, bismuth trichloride, telluryl dichloride or antimony pentachloride.

The organic colour developers employed may be solid carboxylic acids, preferably aliphatic dicarboxylic acids such as tartaric acid, oxalic acid, maleic acid, citric acid, citraconic acid or succinic acid, as well as alkylphenol acetylene resin, maleic acid/rosin resin, carboxy polymethylene or a partially or completely hydrolysed polymer of maleic anhydride with styrene, ethylene or vinyl methyl ether.

Particularly suitable colour developers are compounds containing a phenolic hydroxyl group. These compounds may be monohydric and polyhydric phenols. These phenols may be substituted by halogen atoms, carboxyl groups, alkyl radicals, aralkyl radicals such as α-methylbenzyl, α,α-dimethylbenzyl, aryl radicals, acyl radicals such as arylsulfonyl, or alkoxycarbonyl radicals or aralkoxycarbonyl radicals such as benzyloxycarbonyl Specific examples of phenols which are suitable for use as component (C) are: 4-tertbutylphenol, 4-phenylphenol, methylenebis(p-phenylphenol), 4-hydroxydiphenyl ether, α-naphthol, β-naphthol, methyl or benzyl 4-hydroxybenzoate, methyl 2,4-dihydroxybenzoate, 4-hydroxydiphenylsulfone, 4'-hydroxy-4-methyldiphenylsulfone, 4'-hydroxy-4-isopropoxydiphenylsulfone, 4-hydroxyacetophenone, 2,4-dihydroxybenzophenone, 2,2'-dihydroxydiphenyl, 2,4-dihydroxydiphenylsulfone, 4,4'-cyclohexylidenediphenol, 4,4'-isopropylidenediphenol, 4,4'-isopropylidenebis(2-methylphenol), 4,4-bis(4-hydroxyphenyl)valeric acid, 1-phenyl-2,2-bis(4-hydroxyphenyl)butane, 1-phenyl-1,1-bis(4-hydroxyphenyl)butane, resorcinol, hydroquinone, pyrogallol, phloroglucinol, p-, m-o-hydroxybenzoic acid, 3,5-di-(α-methylbenzyl)salicylic acid, 3,5-di(α,α-dimethylbenzyl)salicylic acid, salicylosalicylic acid, alkyl gallate, gallic acid, hydroxyphthalic acid, dimethyl hydroxyphthalate, 1-hydroxy-2-naphthoic acid or phenol/formaldehyde prepolymers which may also be modified with zink. The preferred cited carboxylic acids are the salicylic acid derivatives which are preferably used as zinc salts. Particularly preferred zinc salicylates are disclosed in EP-A-181 283 or DE-A-2 242 250.

Also particularly suitable for use as component (C) are organic complexes of zinc thiocyanate and, more particularly, an antipyrine complex of zinc thiocyanate, a pyridine complex of zinc thiocyanate or a cresidine complex of zinc thiocyanate as described in EP-A-97 620.

Particularly preferred components (C) are activated clay, metal-free phenols, phenolic resins (novolak resins) or zinc-modified phenolic resins.

The developers may also be used in admixture with basically inert or almost inert pigment or other modifiers such as silica gel or UV absorbers such as 2-(2'-hydroxyphenyl)-benzotriazoles, benzophenones, cyanoacrylates, or phenyl salicylates. Examples of such pigments are: talcum, titanium dioxide, alumina, hydrated alumina, zink oxide, chalk, clays such as kaolin, as well as organic pigments, for example urea/formaldehyde condensates (BET surface area 2–75 $m^2/g$) or melamine/formaldehyde condensates.

The ratio of component (C) to components (A) and (B) depends on the nature of the three components, on the nature of the colour change, on the colour reaction temperature and, of course, also on the desired colour concentration. Satisfactory results are obtained by using the colour developing component (C) in amounts of 0.1 to 100 parts by weight, preferably of 1 to 20 parts by weight, per part of components (A) and (B) together.

For the pressure-sensitive recording material, both component (A) as well as component (B) are preferably dissolved jointly or else separately in an organic solvent, and the resultant solutions are conveniently encapsulated by the methods described, for example, in U.S. Pat. Nos. 2,712,507, 2,800,457, 3,016,308, 3,429,827, 3,578,605 and 4,100,103 or in British patent specifications 989 264, 1 156 725, 1 301 052 or 1 355 124. Also suitable are microcapsules which are formed by interfacial polymerisation, for example capsules of polyester, polycarbonate, polysulfonamide, polysulfonate, preferably, however, of polyamide, polyurea or polyurethane. In some cases it suffices to encapsulate only component (A). The encapsulation is usually necessary to separate components (A) and (B) from component (C) and thus to prevent a premature colour formation. This separation can also be achieved by incorporating components (A) and (B) in foam-like, sponge-like or honeycomb-like structures.

Illustrative of suitable solvents are preferably non-volatile solvents such as a halogenated benzene, diphenyl or paraffin, for example chloroparaffin, trichlorobenzene, monochlorodiphenyl, dichlorodiphenyl, or trichlorodiphenyl; and ester such as dibutyl adipate, dibutyl phthalate, dioctyl phthalate, butylbenzyl adipate, trichloroethylphosphate, trioctyl phosphate, tricresyl phosphate; an aromatic ether such as benzylphenyl ether; hydrocarbon oils such as paraffin oil or kerosene, aromatic hydrocarbons, for example an alkylated derivative, for example an isopropyl, isobutyl, sec-butyl or tert-butyl derivative, of diphenyl, naphthalene or terphenyl, dibenzyltoluene, a partially hydrogenated terphenyl, a mono- to tetraalkylated diphenylalkene containing 1 to 3 carbon atoms in each of the alkyl moieties, dodecylbenzene, a benzylated xylene, phenyl xylyl ethane, or other chlorinated or hydrogenated condensed hydrocarbons. Mixtures of different solvents, especially mixtures of paraffin oils or kerosene and diisopropylnaphthalene or partially hydrogenated terphenyl, are often used to achieve an optimum solubility for the colour formation, a rapid and intense coloration, and a viscosity which is advantageous for the microencapsulation.

The microcapsules containing components (A) and (B) can be used for the production of a very wide range of known kinds of pressure-sensitive copying materials. The various systems differ substantially from one another in the arrangement of the capsules and of the colour reactants, and in the nature of the substrate.

A preferred arrangement is that in which the encapsulated components (A) and (B) are in the form of a layer on the back of a transfer sheet and the electron acceptor (component (C)) is in the form of a layer on the face of a receiving sheet. The reverse arrangement is also possible. Another arrangement of the components is that wherein the microcapsules containing components (A) and (B) and the developer (component (C) are in or on the same sheet, in the form of one or more individual layers, or are incorporated in the substrate.

To obtain the desired colour, the capsule material which contains components (A) and (B) can be mixed with other capsules which contain conventional colour formers. Similar results are obtained by encapsulating components (A) and (B) jointly with one or more conventional colour formers.

The capsules are preferably secured to the support by means of a suitable binder. As paper is the preferred substrate, these binders are principally paper-coating agents, for example gum arabic, polyvinyl alcohol, hydroxymethylcellulose, casein, methyl cellulose, dextrin, starch or starch derivatives or polymer latices. These last mentioned substances are e.g. butadiene/styrene copolymers or acrylic homopolymers or copolymers.

The paper employed comprises not only normal paper made from cellulose fibres, but also paper in which the cellulose fibres are replaced (partially or completely) by synthetic polymers. The substrate may also be a plastic sheet.

The copying material preferably comprises a capsule-free layer which contains components (A) and (B) and a colour developing layer containing, as colour developer (component (C)), at least one inorganic metal salt of a polyvalent metal, preferably a halide or a nitrate, for example zinc chloride, tin chloride, zinc nitrate or a mixture thereof.

The ternary colour former system of this invention comprising components (A), (B) and (C) is particularly suitable for the production of a heat-sensitive recording material for use in thermography. In this utility, components (A), (B) and (C) come into contact with one another when heated to form a colour and develop images on the substrate.

The heat-sensitive recording material normally comprises at least one substrate, components (A), (B) and (C) and, in some cases, also a binder and/or wax. If desired, the recording material may additionally contain an activator, for example benzyl diphenyl, benzyloxy naphthalene, or a sensitiser.

Thermoreactive recording systems typically comprise heat-sensitive recording and copying materials and papers. These systems are typically used for recording information, for example in computers, printers, facsimile or copying machines, or in medical and technical recording and measuring instruments, as in electrocardiographs, or for marking labels or bar codes. The image formation (marking) can also be effected manually with a heated pen. Laser beams can also be used to produce heat-induced marks. The thermoreactive recording material can be composed such that components (A) and (B) are dispersed or dissolved in one binder layer and the developer (component (C)) is dissolved or dispersed in the binder in a second layer. An alternative method comprises dispersing all three components in the same layer. By means of heat the layer or layers are softened or fused, whereupon components (A), (B) and (C) come into contact with one another at the areas where heat is applied and the desired colour develops at once.

Component (A) and/or (B) may also be encapsulated in the thermoreactive recording material.

Fusible, film-forming binders are preferably used for the preparation of the heat-sensitive recording material. These binders are normally water-soluble, whereas components (A), (B) and (C) are insoluble in water. The binder should be able to disperse the three components at room temperature and fix them on the support.

Examples of binders which are soluble, or at least swellable, in water are hydrophilic polymers such as polyvinyl alcohol, alkali metal polyacrylates, hydroxyethylcellulose, methyl cellulose, carboxmethylcellulose, polyacrylamide, polyvinyl pyrrolidone, carboxylated butadiene/styrene copolymers, gelatin, starch, or esterified corn starch.

If components (A), (B) and (C) are in two or three separate layers, it is possible to use water-insoluble binders, i.e. binders which are soluble in non-polar or only weakly polar solvents, for example natural rubber, synthetic rubber, chlorinated rubber, polystyrene, styrene/butadiene copolymers, polymethylacrylates, ethyl cellulose, nitrocellulose or polyvinyl carbazole. The preferred arrangement, however, is that in which all three components are contained in one layer in a water-soluble binder.

To ensure the stability of the heat-sensitive recording material or the density of the developed image, the material may be provided with an additional protective layer. Such protective layers consist as a rule of water-soluble and/or water-insoluble resins which are customary polymer materials or aqueous emulsions thereof.

Specific examples of water-soluble polymer materials are polyvinyl alcohol, starch, starch derivatives, cellulose derivatives such as methoxy cellulose, hydroxyethyl cellulose, carboxymethyl cellulose, methyl cellulose or ethyl cellulose, sodium polyacrylate, polyvinyl pyrrolidone, polyacrylamide/acrylate copolymers, acrylamide/acrylate/methacrylic acid copolymers, styrene/maleic anhydride copolymer alkali metal salts, isobutene/maleic anhydride copolymer alkali metal salts, polyacrylamide, sodium alginate, gelatin, casein, water-soluble polyesters or carboxyl-modified polyvinyl alcohol.

The following water-insoluble resins may, if desired, be used in the protective coating in conjunction with the cited water-soluble polymer resins: polyvinyl acetate, polyurethanes, styrene/butadiene copolymers, polyacrylic acid, polyacrylates, vinyl chloride/vinyl acetate copolymers, vinyl alcohol/vinyl acetate/maleic acid terpolymers, polybutyl methacrylate, ethylene/vinyl acetate copolymers and styrene/butadiene/acrylate copolymers.

Both the thermoreactive coatings as well as the resin coatings may contain further modifiers. To enhance the degree of whiteness or the suitability of the recording material for the thermoprinting head and to prevent the heated nib or plate from sticking, these coatings may contain, for example, antioxidants, UV absorbers, solubilisers, talcum, titanium dioxide, zinc oxide, hydrated alumina, calcium carbonate (e.g. chalk), clays or also organic pigments, for example urea/formaldehyde polymers. So that the colour formation is effected only within a limited temperature range, it is possible to add substances such as urea, thiourea, diphenyl thiourea, acetamide, acetanilide, benzosulfanilide, bis(stearoyl)ethylenediamide, stearamide, phthalic anhydride, benzyl benzyloxybenzoate, metal stearates such as zinc stearate, phthalonitrile, dibenzyl terephthalate, dimethyl terephthalate or other suitable fusible products which induce the simultaneous melting of the colour former and the developer. Thermographic recording materials preferably contain waxes, e.g. carnauba wax, montan wax, paraffin wax, microwax, polyethylene wax, condensates of higher fatty acid amides and formaldehyde, or condensates of higher fatty acids and ethylenediamine.

To improve the usefulness of the thermochromatic material, the three components (A), (B) and (C) can be encapsulated in microcapsules. To this end, any of the above mentioned per se known methods for encapsulating colour formers or other chemical agents in microcapsules can be employed.

In the following Working Instructions and Examples, the percentages are by weight, unless otherwise stated. Parts are by weight.

EXAMPLE 1

2.2 g of 4-dimethylaminobenzaldehyde are dissolved in 100 g of diisopropylnaphthalene and the solution is mixed with a solution of 2 g of 3-amino-4-methoxytoluene in 100 g of diisopropylnaphthalene. The mixture is coated with a doctor blade (10 μm) on to a sheet of paper whose surface is coated with acid-modified bentonite (CF sheet). An intense, lightfast yellow image develops.

EXAMPLE 2

The mixture obtained in Example 1 is applied to a sheet of paper which is coated with zinc salicylate in accordance with EP-A-181 283, Example 1, to give also an intense, lightfast yellow image.

EXAMPLE 3

The mixture obtained in Example 1 is applied to a sheet of paper which is coated with a phenolic resin as co-reactant, to give a lightfast yellow image with λ-max. 460 nm.

EXAMPLE 4

1.2 g of 4-dimethylaminocinnamaldehyde are dissolved in 100 g of diisopropylnaphthalene and the solution is mixed with a solution of 0.94 g of 3-amino-4-methoxytoluene in 100 g of diisopropylnaphthalene. The mixture is printed with a 15 μm gravure printing plate on a CF sheet which is coated with acid-modified bentonite. An intense, lightfast violet image develops.

EXAMPLE 5

The mixture obtained in Example 4 is applied to a sheet of paper which contains a zinc salicylate as co-reactant, to give a lightfast violet image ($\lambda_{max}$ 560 nm).

EXAMPLE 6

A dispersion A is prepared by milling 0.97 g of indole-3-aldehyde, 3.5 g of a 10% aqueous solution of polyvinyl alcohol (Polyviol V03/140) and 2 g of water with glass beads to a granular size of 2–4 μm.

A dispersion B is prepared by milling 1.17 g of 1-phenyl-3-methyl-5-pyrazolone, 3.5 g of a 10% aqueous solution of polyvinyl alcohol (Polyviol V03/140) and 2 g of water with glass beads to a granular size of 2–4 μm.

A dispersion C is prepared by milling 6 g of the zinc salicylate according to EP-A-181 283, Example 1, 21 g of a 10% aqueous solution of polyvinyl alcohol (Polyviol V03/140) and 2 g of water with glass beads to a granular size of 2–4 μm.

Dispersions A, B and C are then mixed and applied with a 15 μm gravure printing plate to a sheet of paper to a dry coating weight of 4 g/m$^2$. A lightfast yellow image develops by contacting the paper with a heated metal stylus.

EXAMPLE 7

1.4 g of 3,3-bis(4'-dimethylaminophenyl)-6-dimethylaminophthalide, 1.0 g of N-butylcarbazol-3-yl-bis(4'-N-methyl-N-phenylaminophenyl)methane, 0.5 g of 3,3-bis-(N-n-octyl-2'-methylindol-3'-yl)-phthalide, 0.66 g of 4-dimethylaminobenzaldehyde and 0.6 g 3-amino-4-methoxytoluene are dissolved in 96 g of diisopropylnaphthalene and the solution is printed with a 15 μm gravure printing plate on a CF sheet whose surface is coated with acid-modified bentonite. An intense, lightfast black image develops.

EXAMPLE 8

0.51 g of 4-dimethylaminocinnamaldehyde are dissolved in 50 g of diisopropylnaphthalene and the solution is mixed with a solution of 0.54 g of 4-aminodiphenylamine in 50 g of diisopropylnaphthalene. The solution is printed with a 15 μm gravure printing plate on a CF sheet whose surface is coated with activated clay. An intense, lightfast bluish-violet image ($\lambda_{max}$ 560 nm) develops immediately.

EXAMPLE 9

The procedure described in Example 8 is repeated, replacing 4-dimethylaminocinnamaldehyde by the same amount of 4-dimethylaminobenzaldehyde. An intense, lightfast orange image ($\lambda_{max}$ 490 nm) is obtained.

EXAMPLE 10

0.56 g of 4-dimethylaminobenzaldehyde and 0.51 g of 4-isopropylaniline are dissolved in diisopropylnaphthalene to give a 1% solution. The solution is microencapsulated in known manner with gelatin and carboxymethyl cellulose and glutaraldehyde by coacervation. The resultant capsule dispersion is mixed with 5 g of a 20% aqueous polyvinyl alcohol solution and starch solution and 11 g of starch grains, and the mixture is coated on base paper having a weight of 50 g/m$^2$ and dried for 10 minutes at 30° C. The dry coating weight is 8 g/m$^2$. The CB sheet so obtained is laid on a CF sheet which contains activated clay. When pressure is exerted on the recording material, a yellow image having an optical density of 0.56 and $\lambda_{max}$ 460 nm forms immediately.

EXAMPLE 11

0.6 g of 4-dimethylaminocinnamaldehyde and 0.46 g of 4-isopropylaniline are dissolved in diisopropylnaphthalene to give a 1% solution. The solution is microencapsulated in known manner with gelatin and carboxymethyl cellulose and glutaraldehyde by coacervation. The resultant capsule dispersion is mixed with 5 g of a 20% aqueous polyvinyl alcohol solution and starch solution and 11 g of starch grains, and the mixture is coated on base paper having a weight of 50 g/m$^2$ and dried for 10 minutes at 30° C. The dry coating weight is 8 g/m$^2$. The CB sheet so obtained is laid on a CF sheet which contains activated clay. When pressure is exerted on the recording material, a magenta image having an optical density of 0.76 and $\lambda_{max}$ 560 nm forms immediately.

EXAMPLE 12

0.51 g of 4-dimethylaminocinnamaldehyde and 0.54 g of 4-aminodiphenylamine are dissolved in diisopropylnaphthalene to give a 1% solution. The solution is microencapsulated in known manner with gelatin and carboxymethyl cellulose and glutaraldehyde by coacervation. The resultant capsule disperion is mixed with 5 g of a 20% aqueous polyvinyl alcohol solution and starch solution and 11 g of starch grains, and the mixture is coated on base paper having a weight of 50 g/m$^2$ and dried for 10 minutes at 30° C. The dry coating weight is 8 g/m$^2$. The CB sheet so obtained is laid on a CF sheet which contains activated clay. When pressure is exerted on the recording material, a magenta image having an optical density of 0.78 and $\lambda_{max}$ 560 nm forms immediately.

What is claimed is:

1. A pressure-sensitive or heat-sensitive recording material comprising a substrate and a colour reactant system comprising (A) an aromatic or nitrogen-containing heterocyclic aldehyde, (B) an organic condensation component containing an activated methylene group or a primary or secondary nitrogen atom and (C) an electrophilic and colour-developing component.

2. A recording material according to claim 1, wherein component (A) is an aromatic aldehyde of formula

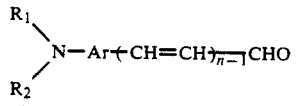

(1)

wherein $R_1$ and $R_2$ are each independently of the other alkyl of not more than 12 carbon atoms which is unsubstituted or substituted by halogen hydroxy, cyano or lower alkoxy, or acyl of 1 to 8 carbon atoms, cycloalkyl of 5 to 10 carbon atoms, or phenylalkyl containing 1 to 3 carbon atoms in the alkyl moiety or phenyl, each unsubstituted or ring-substituted by halogen, cyano, lower alkyl, lower alkoxy or lower alkoxycarbonyl, and $R_2$ is also hydrogen, or $R_1$ and $R_2$, together with the linking nitrogen atom, are a 5- or 6-membered, saturated, heterocyclic radical, Ar is naphthylene or phenylene which is unsubstituted or substituted by hydroxy, halogen, cyano, nitro, trihalomethyl, lower alkyl, methylsulfonyl, lower alkoxy, acyloxy, lower alkylamino, di-lower alkylamino, acylamino containing 1 to 8 carbon atoms, benzyloxy or phenoxy, and n is 1 or 2.

3. A recording material according to claim 2, wherein $R_1$ and $R_2$ are each lower alkyl, chloro-lower alkyl, cyano-lower alkyl, benzyl, phenyl, or $-NR_1R_2$ is pyrrolidino, piperidino or morpholino, Ar is naphthylene or phenylene which is unsubstituted or substituted by hydroxy, halogen, trifluoromethyl, lower alkyl or lower alkoxy, and n is 1 or 2.

4. A recording material according to claim 1, wherein component (A) is an aromatic compound of formula

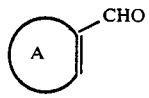

(2)

wherein A is a mononuclear or polynuclear aryl radical which is unsubstituted or substituted by hydroxy, halogen, cyano, nitro, lower alkyl, lower alkoxy or lower alkoxycarbonyl.

5. A recording material according to claim 1, wherein component (A) is a nitrogen-containing heterocyclic aldehyde of formula

Z-CHO (3)

wherein Z is an unsubstituted or substituted pyrrolyl, antipyrinyl, triazinyl, indolyl, carbazolyl, julolidinyl, kairolinyl, indolinyl, iminodibenzyl, dihydroquinolinyl or tetrahydroquinolinyl radical.

6. A recording material according to claim 5, wherein Z in formula (3) is a pyrrol-2-yl, N-$C_1$–$C_8$alkyl-pyrrol-2-yl, N-phenylpyrrol-3-yl, indol-3-yl, 2-methylindol-3-yl, N-$C_1$–$C_8$alkyl-2-methylindol-3-yl, N-$C_2$–$C_4$alkanoyl-2-methylindol-3-yl, 2-phenylindol-3-yl, N-$C_1$–$C_8$alkyl-2-phenylindol-3-yl, N-$C_1$–$C_8$alkylcarbazol-3-yl or 1,3,3-trimethyl-2-methenylindolinyl radical.

7. A recording material according to claim 1, wherein the condensation component (B) is selected from the group consisting of anilines, naphthylamines, aminophenylethylene compounds, aminophenylstyrene compounds, acylacetarylamides, 3-aminophenol ethers, aminopyrazoles, aminothiazoles, pyrazolones, barbituric acids, pyrrolidines, piperidines, piperazines, morpholines, benzomorpholines, indolines, cyanomethylbenzimidazoles, cyanomethylbenzoxazoles and cyanomethylbenzothiazoles.

8. A recording material according to claim 1, wherein component (B) is selected from the group consisting of anilines, cresidines, phenetidines, aminodiphenylamines and toluidinesulfoanilides.

9. A recording material according to claim 1, wherein component (B) is an aniline of formula

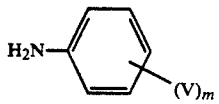

(4)

wherein

V is hydrogen, hydroxy, halogen, trifluoromethyl, lower alkyl, lower alkoxy, lower alkoxycarbonyl, lower alkanoyloxy, benzyloxy or phenoxy, and m is 1 or 2.

10. A recording material according to claim 1, wherein the condensation component (B) is an aminodiphenylamine.

11. A recording material according to claim 1, wherein the condensation component (B) is a fluoran or phthalide which contains an unsubstituted amino group.

12. A recording material according to claim 1, wherein the colour-developing component (C) is selected from the group consisting of a Lewis acid, an activated clay, a solid carboxylic acid and a compound containing a phenolic hydroxyl group.

13. A recording material according to claim 1, wherein the colour developing component (C) is selected from the group consisting of an activated clay, a zinc salicylate, a metal-free phenolic compound, a phenolic resin and a zinc thiocyanate complex.

14. A recording material according to claim 1 which is pressure-sensitive.

15. A recording material according to claim 14, wherein components (A) and (B) are dissolved in an organic solvent.

16. A recording material according to claim 15, wherein components (A) and (B) are encapsulated in microcapsules.

17. A recording material according to claim 16, wherein components (A) and (B) are incorporated in one back layer or independently into two back layers of a transfer sheet and component (C) is present in a front layer of a receiver sheet.

18. A pressure-sensitive recording material according to claim 14, wherein component (C) is an activated clay or a zinc salicylate.

19. A recording material according to claim 1 which is heat-sensitive.

20. A recording material according to claim 19, which comprises 1 to 4 layers on a substrate, wherein components (A), (B) and (C) are incorporated each together with a binder or wax in at least one of the layers.

21. A recording material according to claim 1, wherein components (A) and (B) are present together with one or more conventional colour formers.

22. A recording material according to claim 21, wherein the conventional colour former is selected from the group consisting of 3,3-(bisaminophenyl)phthalides, 3-indolyl-3-aminophenylaza-or -diazaphthalides, (3,3-bisindolyl)-phthalides, 3-aminofluorans, 6-dialkylamino-2-dibenzylaminofluorans, 6-dialkylamino-3-methyl-2-arylaminofluorans, 3,6-bisalkoxyfluorans, 3,6-bis(diarylamino)fluorans, leucoauramines, spiropyranes, spirodipyranes, chromenopyrazoles, chromenoindoles, phenoxazines, phenothiazines, quinazolines, rhodamine lactams, carbazolylmethanes and triarylmethaneleuco dyes.

23. A recording material according to claim 1, wherein the colour developing component (C) is a zinc-modified phenolic resin.

* * * * *